US006835091B2

(12) United States Patent
Oleynick et al.

(10) Patent No.: US 6,835,091 B2
(45) Date of Patent: Dec. 28, 2004

(54) UNIVERSAL SERIAL BUS ELECTRICAL CONNECTOR

(75) Inventors: Gary J. Oleynick, Encinitas, CA (US); Robert E. MacMullin, Wellsville, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/900,507

(22) Filed: Jul. 6, 2001

(65) Prior Publication Data

US 2003/0008553 A1 Jan. 9, 2003

(51) Int. Cl.[7] ..... H01R 13/60
(52) U.S. Cl. ..... 439/541.5; 439/79; 439/607
(58) Field of Search ..... 439/541.5, 79, 439/607, 160; 361/78, 79

(56) References Cited

U.S. PATENT DOCUMENTS

| | | | | | |
|---|---|---|---|---|---|
| 5,295,843 | A | * | 3/1994 | Davis et al. | 439/108 |
| 5,637,015 | A | * | 6/1997 | Tan et al. | 439/607 |
| 5,685,739 | A | | 11/1997 | Davis et al. | 439/607 |
| 5,772,453 | A | | 6/1998 | Tan et al. | 439/79 |
| 5,938,473 | A | * | 8/1999 | Nishio et al. | 439/567 |
| 5,954,523 | A | | 9/1999 | Babcock | 439/79 |
| 6,007,379 | A | * | 12/1999 | Michaelis et al. | 439/607 |
| 6,027,375 | A | | 2/2000 | Wu | 439/607 |
| 6,053,773 | A | * | 4/2000 | Wu | 439/541.5 |
| 6,089,879 | A | | 7/2000 | Babcock | 439/79 |
| 6,108,198 | A | | 8/2000 | Lin | 361/683 |
| 6,155,872 | A | * | 12/2000 | Wu | 439/541.5 |
| 6,159,039 | A | * | 12/2000 | Wu | 439/541.5 |
| 6,162,089 | A | * | 12/2000 | Costello et al. | 29/832 |
| 6,165,014 | A | * | 12/2000 | Kao et al. | 439/607 |
| 6,166,892 | A | * | 12/2000 | Wu | 361/79 |
| 6,168,468 | B1 | * | 1/2001 | Zhu et al. | 439/607 |
| 6,183,292 | B1 | * | 2/2001 | Chen et al. | 439/541.5 |
| 6,183,300 | B1 | * | 2/2001 | Belopolsky et al. | 439/607 |
| 6,217,378 | B1 | * | 4/2001 | Wu | 439/567 |
| 6,238,244 | B1 | | 5/2001 | Yang | 439/607 |
| 6,273,757 | B1 | * | 8/2001 | David et al. | 439/607 |
| 6,296,521 | B1 | * | 10/2001 | Chang et al. | 439/607 |
| 6,346,009 | B1 | * | 2/2002 | Lin | 439/607 |

OTHER PUBLICATIONS

1. Berg Electronics, drawings for USB + Power Receptacle Assembly, 3 sheets.
2. Berg Electronics, drawings for USB + Poer Plug Kit Assembly, 3 sheets.

* cited by examiner

*Primary Examiner*—Gary Paumen
*Assistant Examiner*—Edwin A. Leon
(74) *Attorney, Agent, or Firm*—Harrington & Smith, LLP

(57) ABSTRACT

An electrical connector comprising electrical signal contacts and power contacts; and a housing. The housing has the electrical contacts connected thereto. The housing includes at least two vertically offset electrical plug receiving areas. The signal contacts extend into the receiving areas in a universal serial bus (USB) electrical conductor location configuration. The power contacts also extend into the receiving areas, but in an opposite direction from the signal contacts.

33 Claims, 6 Drawing Sheets

UNIVERSAL SERIAL BUS ELECTRICAL CONNECTOR

BACKGROUND OF THE INVENTION

1. Field of the Invention

The present invention relates to electrical connectors and, more particularly, to a universal serial bus electrical connector.

2. Brief Description of Prior Developments

Universal serial bus (USB) electrical connectors are well known in the art. There also exists in the art a form of USB electrical connector system which includes power contacts on the plug and in the receptacle. One such USB and power electrical connector system is sold by FCI USA, Inc. under the part numbers 742394 for the receptacle and 74233 for the plug. U.S. Pat. No. 5,637,015 discloses a USB connector having shielding and two areas vertically aligned for receiving two USB connectors. However, the receptacle disclosed in this patent is not adapted to have USB+power electrical plugs connected to it.

There is a desire to provide a USB+power electrical receptacle which can receive more than one USB+power electrical plug. However, there is also a desire to keep USB electrical receptacles and plugs relatively small. This can be extremely beneficial in a relatively small component such as a laptop computer, or an electrical or electronic device where space for mounting USB plugs is limited. There is also a desire to ensure that the electrical power supplied through power contacts in a multi-plug receiving receptacle does not cause false electrical signals in the associated signal contacts or conductors in the receptacle or mating plugs.

SUMMARY OF THE INVENTION

In accordance with one embodiment of the present invention, an electrical connector is provided comprising electrical signal contacts and power contacts; and a housing. The housing has the electrical contacts connected thereto. The housing includes at least two vertically offset electrical plug receiving areas. The signal contacts extend into the receiving areas in a universal serial bus (USB) electrical conductor location configuration. The power contacts also extend into the receiving areas, but in an opposite direction from the signal contacts.

In accordance with another embodiment of the present invention, a universal serial bus (USB) electrical connector is provided comprising a housing and electrical contacts. The housing forms a plurality of USB plug receiving areas. The electrical contacts include signal contacts and power contacts. The electrical signal contacts are connected to the housing, and extend into the receiving areas, arranged for operably electrically connecting to the USB plugs inserted into the USB plug receiving areas. The electrical power contacts are connected to the housing and extending into the receiving areas. The housing has a section between two of the receiving areas. The power contacts extend from the section in opposite directions into the two receiving areas.

In accordance with another embodiment of the present invention, an electrical connector is provided comprising a housing having two plug receiving areas vertically offset relative to each other; and electrical contacts connected to the housing and extending into the two plug receiving areas. The contacts comprise signal contacts and power contacts. The power contacts extend into the two receiving areas and the signal contacts extend into the two receiving areas. The signal and power contacts which extend into a first one of the receiving areas are arranged in an array which is substantially a mirror image of the signal and power contacts in a second one of the receiving areas.

In accordance with another embodiment of the present invention, a universal serial bus (USB) electrical connector receptacle for receiving a plurality of USB electrical connector plugs is provided. The receptacle comprises a housing having at least one plug receiving area; and electrical contacts connected to the housing. The contacts comprise signal contacts and power contacts. The at least one plug receiving area is sized and shaped to receive the plurality of USB plugs with signal contact supporting decks of two of the plugs being located vertically offset relative to each other and power contact supporting sections of the two plugs being at least partially laterally adjacent each other.

In accordance with another embodiment of the present invention, an electrical connector is provided comprising a housing having at least one plug receiving area; and electrical contacts connected to the housing. The contacts comprise signal contacts and power contacts. The at least one plug receiving area comprises a first receiving area section sized and shaped to receive a first electrical plug having a signal contact supporting deck and a power contact section; and a second receiving area section sized and shaped to receive a second electrical plug having a signal contact supporting deck and a power contact section. At least one of the first and second receiving area sections is sized and shaped to alternatively receive a third electrical plug having a signal contact supporting deck, but not having a power contact section.

In accordance with another embodiment of the present invention, a universal serial bus (USB) electrical connector plug is provided comprising a signal contact supporting deck; electrical signal conductors directly stationarily attached to a first side of the supporting deck; and electrical power conductors directly stationarily attached to an opposite second side of the supporting deck. The supporting deck is sized and shaped to be inserted into a supporting deck receiving aperture of a USB electrical connector receptacle. The electrical signal conductors are aligned in a USB contact array configuration.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
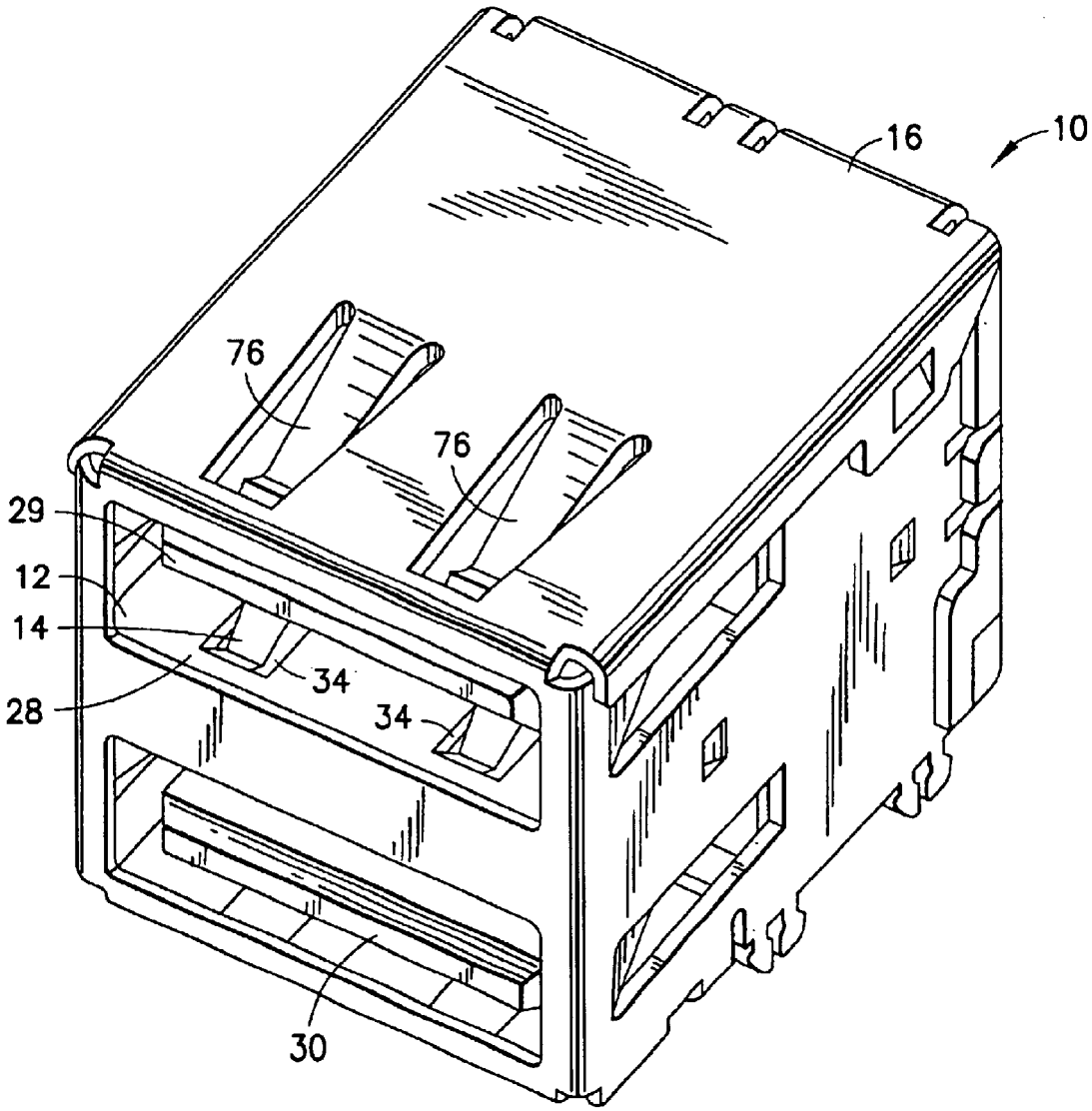
FIG. 1 is a perspective view of an electrical connector incorporating features of the present invention.

Referring to FIG. 1, there is shown a perspective view of an electrical connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
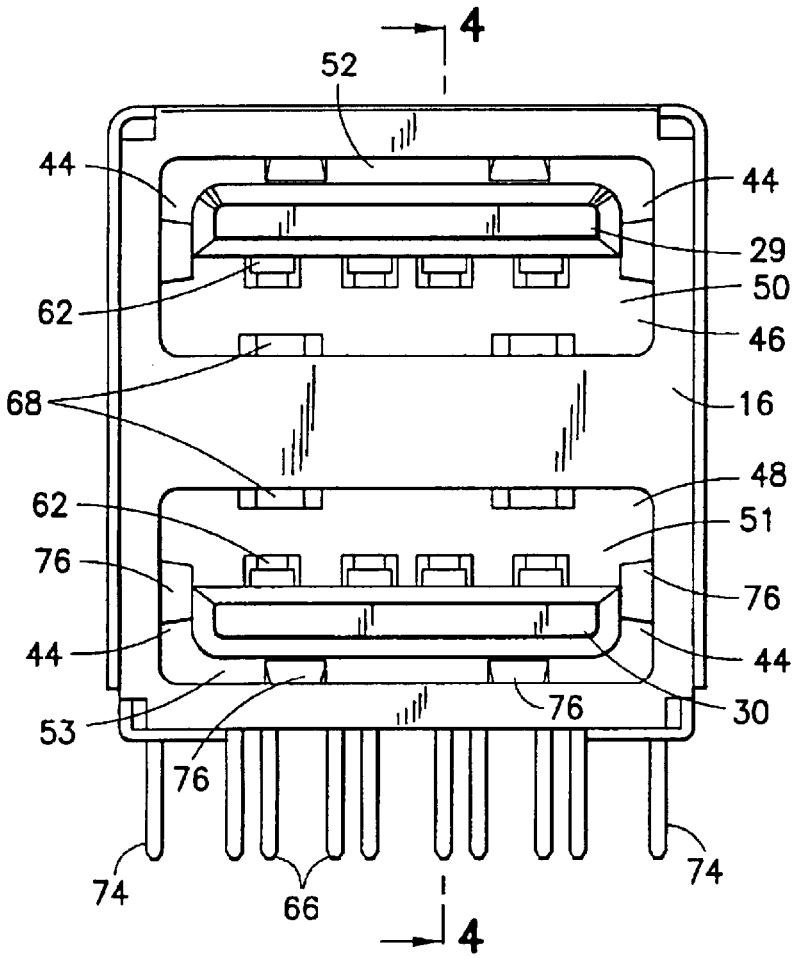
FIG. 2 is a front elevational view of the connector shown in FIG. 1.
Figure 3:
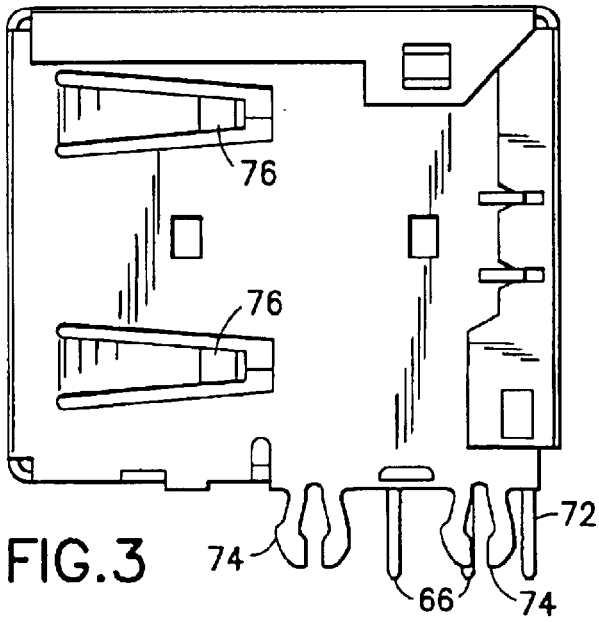
FIG. 3 is a right side elevational view of the connector shown in FIG. 1.
Figure 4:
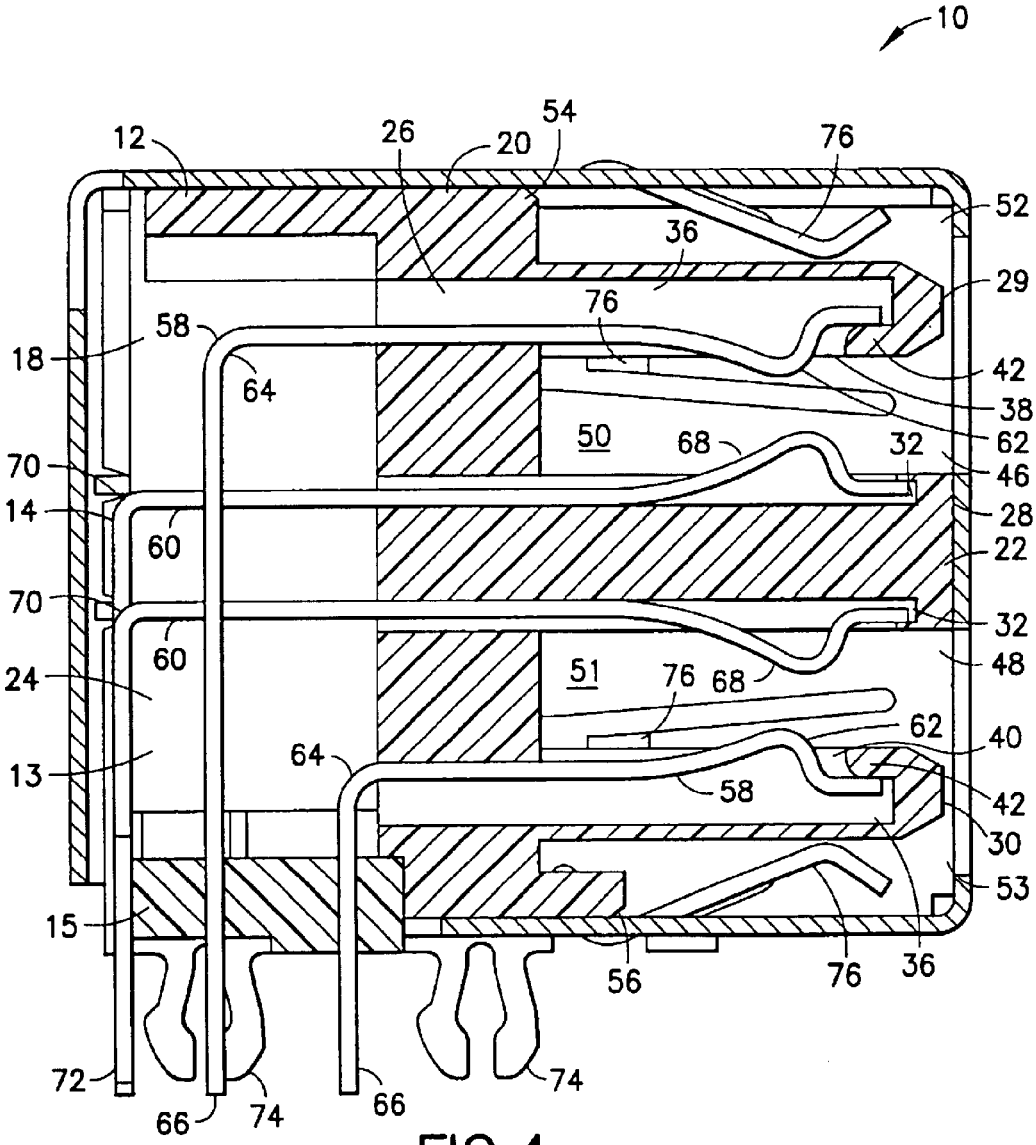
FIG. 4 is a cross sectional view of the connector shown in FIG. 2 taken along line 4—4.

The connector 10 generally comprises a housing 12, electrical contacts 14, and an outer shell 16. Referring also to FIGS. 2–4 the housing 10 is preferably comprised of a two-piece member made of molded plastic or polymer material. However, in an alternate embodiment, the housing could he comprised of more or less than two members 13, 15. In addition, the housing could be comprised of any suitable materials) and could be manufactured by any suitable type of manufacturing process. The second member 15 is fixedly connected to the first member 13. The second member 15 comprises holes for locating bottom ends of the contacts 14 relative to each other.

In the embodiment shown, the first member 13 of the housing 12 generally comprises a rear section 18, a middle section 20, and a front section 22. However, the housing could have any suitable type of shape. The rear section 18 comprises an open space 24. The open space 24 is provided for rear ends of the contacts 14. The middle section 20 comprises channels 26 for middle sections of the electrical contacts 14 to pass through.

The front section 22 generally comprises three projections 28, 29 and 30. In this embodiment, the three projections 28–30 are vertically offset from each other. The middle projection 28 is about the same width as the middle section 20. The middle projection 28 has channels 32 extending therethrough. Front ends of the channels 32 have holes 34 through top and bottom sides of the middle projection 28.

In this embodiment, the top and bottom projections 29, 30 are substantially mirror images of each other. However, in alternate embodiments, the projections 28–30 could have any suitable size and shape. In this embodiment, the top and bottom projections 29, 30 each comprise a channel 36 extending from the channels 26. The top projection 29 also comprises a hole 38 from its channel 36 through its bottom wall. The bottom projection 30 also has a hole 40 through its top side from its channel 36. However, the sections of the housing which houses front ends of the signal contacts 58 could have any suitable size or shape. Portions of the top and bottom projections 29, 30, located in front of the holes 38, 40, form preload sections 42 for the signal contacts 58. However, preload sections might not be provided. In this embodiment, the top and bottom projections 29, 30 have a width which is less than the width of the center projection 28. Thus, spaces 44 are provided on the lateral sides of the projections 29, 30. However, in alternate embodiments, the spaces 44 might not be provided.

The front section 22 of the housing 12, in cooperation with the shell 16, generally forms two receiving areas 46, 48. The two receiving areas 46, 48 are generally sized and shaped to matingly received a USB plug, such as the plug shown in FIGS. 5A–5C. However, in alternate embodiments, the receiving areas could be sized and shaped to receive any suitable type of USB plug. In another alternate embodiment, the receiving areas could be formed solely by the housing. In addition, although the embodiment shown has only two receiving areas, the connector could have more than two receiving areas.

The top projection 29 is offset from the top end 54 of the housing 12. Therefore, because of this offset and the spaces 441 the top receiving area 46 has a general ring shape extending inward from the front end of the connector 10. The top projection 29 is located inside the general ring shape. The section 50 between the top projection 29 and the middle projection 28 forms an area for receiving a contact supporting deck of the mating plug. The top section 52 of the receiving area 46 forms another area for receiving a different section of the mating plug. However, in alternate embodiments the top receiving area 46 might not have a ring shape. The top receiving area 46 could be comprised of multiple separate areas which receive portions of a single mateable plug. Alternatively, the top receiving area 46 could be comprised of a single, generally block shaped, receiving area.

The bottom projection 30 is offset from the bottom end 56 of the housing 12. Therefore, because of this offset and the spaces 44, the bottom receiving area 48 has a general ring shape extending inward from the front end of the connector 10. The bottom projection 30 is located inside the general ring shape. The bottom receiving area 48, in this embodiment, is substantially a mirror image of the top receiving area 46. However, in an alternate embodiment, the two receiving areas could have different sizes and shapes. Similar to the top receiving area 46, the bottom receiving area 48 has a section 51 between the bottom projection 30 and the middle projection 28. This section 51 forms an area for receiving a contact supporting deck of a mating plug. The section 51 is substantially a mirror image of the section 50. Similar to the top receiving area 46, the bottom receiving area 48 has a section 53 on the opposite side of the projection. The section 53 forms an area for receiving a different portion of the mating plug. Similar to noted above with reference to the top receiving area 46, the bottom receiving area 48 could be comprised of multiple separate areas which receive portions of a single mateable plug. Alternatively, the bottom receiving area 48 could be comprised of a single, generally block shaped, receiving area.

In the embodiment shown, the two receiving areas 46, 48 are vertically offset from each other. As seen in the drawings, the two receiving areas 46, 48 are vertically spaced or stacked relative to each other. The two receiving areas 46, 48 are vertically aligned one above the other. However, in alternate embodiments, the two receiving areas 46, 48 could be at least partially horizontally offset from each other. Although the receiving areas 46, 48 have been described as being substantially mirror images of each other, in an alternate embodiment the receiving areas could be aligned in a substantially identical orientation.

The contacts 14 in this embodiment generally comprises signal contacts 58 and power contacts 60. A first set of the signal and power contacts 58, 60 extend into the first receiving area 46. A second set of the signal and power contacts 58, 60 extend into the second receiving area 48. The first set of signal and power contacts comprise four of the signal contacts 58 and two of the power contacts 60. Similarly, the second set of signal and power contacts comprise four of the signal contacts 58 and two of the power contacts 60. However, in alternate embodiments, the sets of contacts could have different numbers and types of contacts relative to each other. Each set of contacts might not include both power and signal contacts. Each set of contacts could comprise more or less than four signal contacts, and more or less than two power contacts. In the embodiment shown, the first and second sets of contacts are arranged as substantially mirror images of each other. However, in alternate embodiments, the arrangements of the contacts in the first and second sets might be different relative to each other, or the sets might be aligned in a common orientation.

The signal contacts 58 generally comprises a spring contact section 62, a middle section 64, and a tail 66. The spring contact sections 62 are located in the channels 32 of the top and bottom projections 29, 30. The spring contact sections 62 have contact areas which extend out of the holes 38, 40 in opposite directions, generally towards an inward direction, and extend into the deck receiving sections 50, 51 of the two receiving areas 46, 48. In this embodiment, front ends of the spring contact sections 62 are preloaded against the preload sections 42.

The middle sections 64 are generally bent. This allows the tails 66 to be directed towards the bottom end of the housing. The tails 66 extend from the bottom side of the connector for insertion into holes of a printed circuit board or other electronic component. This provides the connector 10 as a general right angle connector. In an alternate embodiment, the middle section 64 might not be bent, such as when connector is a vertical or horizontal connector rather than a right angle connector. In an alternate embodiment, the tails 66 could have any suitable type of shape, such as being configured to be surface mounted.

The power contacts 60 generally comprises a spring contact section 68, a middle section 70, and a tail 72. The spring contact sections 68 are located in the channels 32 of the middle projection 28. The spring contact sections 68 have contact areas which extend out of the channels 32. The contact areas for the spring contact sections 68 of the first set of contacts extend out of the middle projection 28 in an opposite, outward direction relative to the contact areas for the spring contact sections of the second set of contacts. The contact areas for the spring contact sections of the first set of contacts extend upward generally towards the top projection 29 and towards the spring contact sections 62 of the signal contacts 58 in the top projection 29. The contact areas for the spring contact sections of the second set of contacts extend downward generally towards the bottom projection 30 and towards the spring contact sections 62 of the signal contacts 58 in the bottom projection 30.

The middle sections 70 are generally bent. This allows the tails 72 to extend towards and out of the bottom end of the housing. The tails 72, similar to the tails 66, are intended for insertion into holes of a printed circuit board. In an alternate embodiment, the tails 72 could have any suitable type of shape, such as being configured to be surface mounted. In an alternate embodiment, the power contacts could have any suitable type of shape. Although the power contacts have been described herein as having a spring contact section, in an alternate embodiment the power contacts might not have a spring contact section, such as when ends of the power contacts are formed as male pins.

The spring contact sections 62, 68 of the signal and power contacts generally extend towards each other in the two respective deck receiving sections 50, 51 of the receiving areas 46, 48. The spring contact sections 62 of the signal contacts 58 are arranged in an array or configuration that is adapted to operably mate with electrical contacts of a mating USB plug. The USB standards are well known in the art. The deck receiving sections 50, 51 of the receiving areas 46, 48 are sized and shaped to receive a contact supporting deck of a USB plug.

The outer shell 16 generally comprises an electrically conductive ferromagnetic material. The shell 16 forms a ground for the connector as well as an electromagnetic shield. The shell 16 generally surrounds substantially all sides of the housing 12. The shell 16 generally comprises mounting posts 74 which extend from the bottom of the connector. The mounting post are intended to be inserted into holes in a printed circuit board. However, any suitable means could be provided to mount the connector 10 to another component. The shell 16 also comprises spring contact arms 76. In this embodiment, the contact arms 76 extend in inward directions from the four sides of the connector. The contact arms 76 extend into both of the receiving areas 46, 48. For each receiving area 46, 48, two of the contact arms 76 extend into the spaces 44 and two of the contact arms 76 extend into the sections 52, 53 of the receiving areas. However, in alternate embodiments, any suitable type of outer shell could be provided and any suitable means for making an electrical connection with a mating USB plug and could be provided.

Figure 5A:
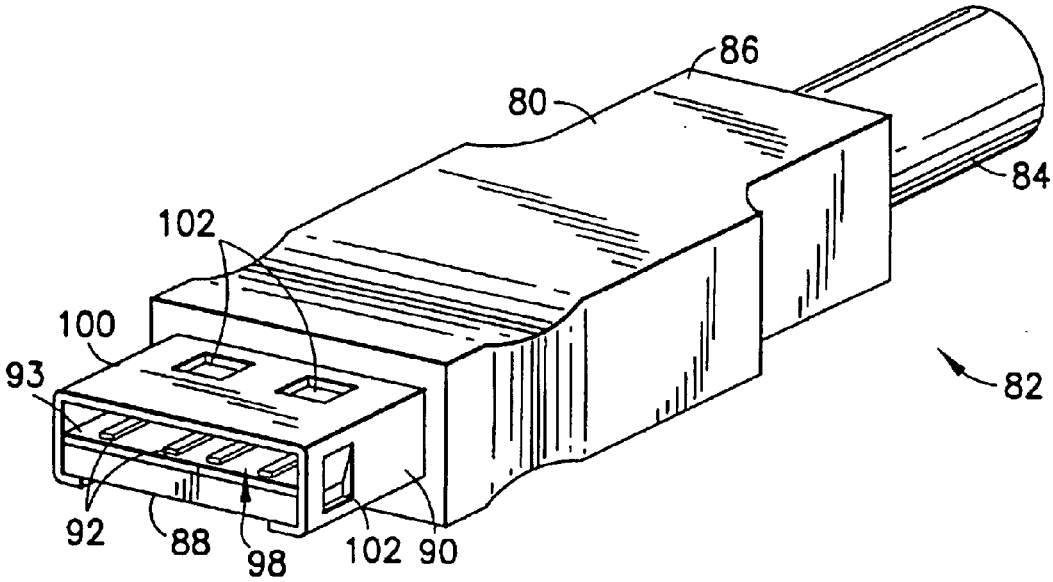
FIG. 5A is a perspective view of a USB+power electrical connector plug incorporating features of the present invention adapted for insertion into the electrical connector receptacle shown in FIG. 1.
Figure 5B:
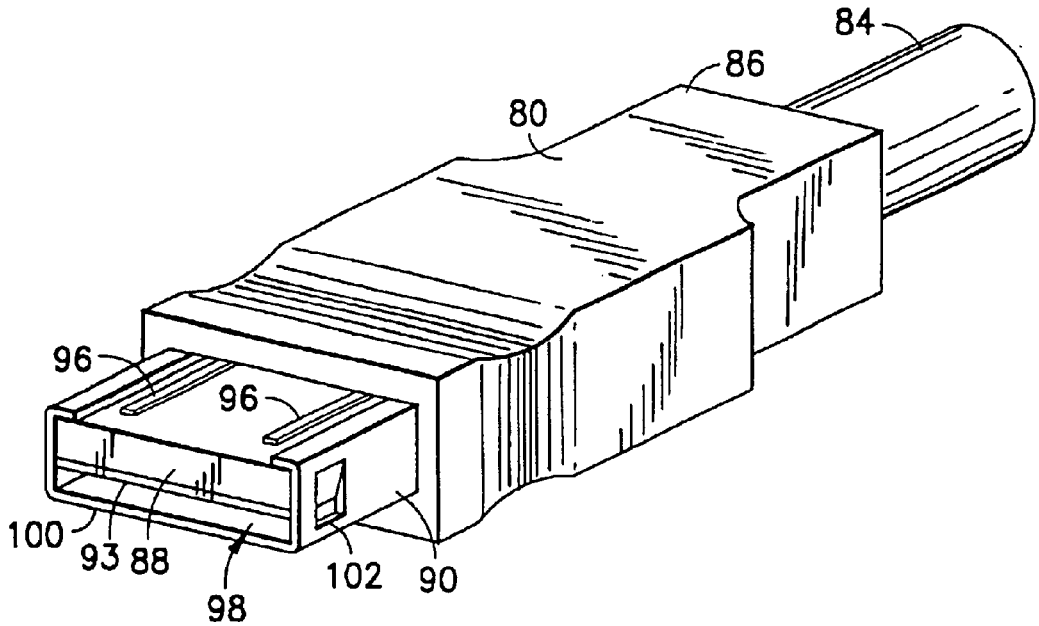
FIG. 5B is a perspective view of the USB+power electrical connector plug shown in FIG. 5A from an opposite direction.
Figure 5C:
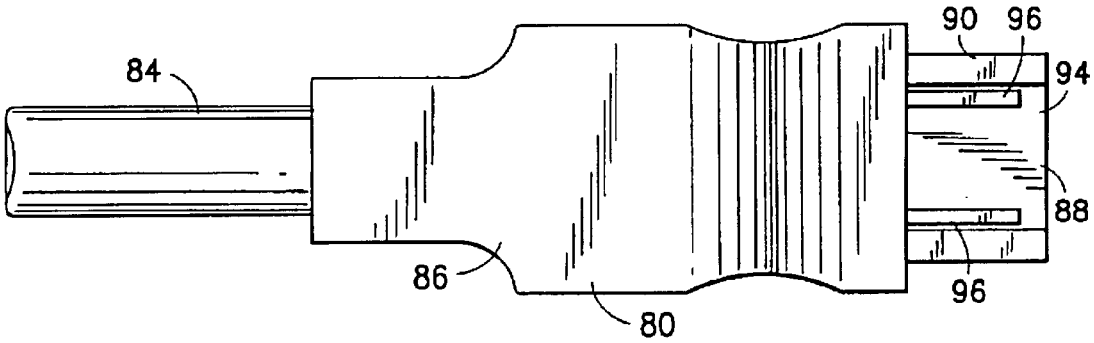
FIG. 5C is a bottom plan view of the connector plug shown in FIG. 5A.

Referring now to FIGS. 5A–5C, one embodiment of a USB plug 80 intended for insertion into the receiving areas of the connector 10 is shown. The plug 80 is shown as part of a cable assembly 82 having an electrical cable 84 connected thereto. The plug 80 generally comprises a housing 86, a contact supporting deck 88, and a shell 90. The contact supporting deck 88 has a general planar shape. The deck 88 extends from a front end of the housing 86. A first side of the deck 88 comprises signal conductors or contacts 92 therealong. In this embodiment, the contacts 92 are arranged in a USD contact configuration. An opposite second side 94 of the deck 88 has two power contacts or conductors 96 therealong. The signal contacts 92 and power contacts 96 are electrically connected to signal and power conductors in the cable 84. The connection between the conductors from the cable and the contacts 92, 96 is protected by the housing 86. In addition, the housing 86 forms a strain relief with the cable 84.

The shell 90 is comprised of electrically conductive ferromagnetic material. The shell extends from the housing 86 in a forward direction. The shell 90 is connected to a ground wire in the cable 84. The shell 90 surrounds three sides of the contact supporting deck 88. The shell 90 wraps partially around the side 94 of the deck, but stops before the shell reaches the power contacts 96. Thus, the power contacts 96 are exposed at the side 94 of the deck. The top side 100 of the shell 90 is spaced from the first side 93 of the deck 88. Therefore, a space 98 is formed between the shell 90 and the side 93 of the deck. This space 98 is sized and shaped to matingly receive either one of the top or bottom projections 29, 30 of the connector 10. The thickness of the shell 90 is sized and shaped to be inserted into the spaces 44, 52 and 53 of the connector 10.

In this embodiment, the shell 90 comprises holes 102 therethrough. The holes 102 are located on the top side 100 and the two lateral sides of the shell. The holes 102 are sized, shaped and located such that when the front end of the plug 80 is inserted into one of the receiving areas 46 or 48 of the connector 10, the spring contact arms 76 of the shell 16 extend into the holes 102 to form a retaining engagement. This retaining engagement helps to prevent the plug 80 from being inadvertently disconnected from the connector 10. In addition, because the two shells 16, 90 are comprised of an electrically conductive ferromagnetic material, the shells 16, 90 are electrically grounded to each other and form a shield around the connection of the signal contacts 58, 92 to each other. However, in alternate embodiments, any suitable type of shell could be provided. In addition, any suitable type of retaining engagement between the plug and the receptacle could be provided.

The plug 80 can be inserted into either one of the receiving areas 46, 48. However, the plug 80 must be flipped 180 degrees based upon which of the two receiving areas 46, 48 the plug is being inserted into. If the plug 80 is inserted into the top receiving area 46, then the top side 100 of the shell 90 would be located towards the top side of the connector and received in the section 52. However, if the plug is inserted into the bottom receiving area 48, then the top side 100 of the shell would be located towards the bottom side of the connector and received in the section 53. As noted above, in an alternate embodiment the configurations of the plug receiving areas 46, 48 might not be mirror images of each other but could be similarly orientated. In that type of alternate embodiment the plug 80 would not need to be flipped to be inserted into either one of the plug receiving areas.

When the plug 80 is inserted into one of the receiving areas 46, 48 the deck 88 is received in one of the sections 50, 51 and sandwiched between the contact areas of the corresponding signal contacts 58 and power contacts 60. The power contacts 60 make a mating electrical connection with the power contacts 96 on the plug 80. The signal contacts 58 make a mating electrical connection with the signal contacts 92 on the opposite side of the deck 88. The top or bottom projection 29, 30 is received in the area 98 of the plug 80.

One of the features of the present invention is the compact design of the connector 10. In particular, the connector 10 provides a section 28 between the two receiving areas 46 and 48 which separates the two areas from each other, but also provides a housing function for power contacts for both of the receiving areas. This allows the front face of the connector 10 to be smaller than otherwise could be provided. This may be particularly important for smaller electronic devices, such as a laptop computer.

Another feature of the present invention is the compact design of the plug 80. By providing the signal contacts 92 and the power contacts 96 on opposite sides of the same contact supporting deck 88, the height of the front end of the connector 80, which is inserted into one of the receiving areas of the connector 10, can be much smaller than a conventional USB plug having power contacts. The deck 88 can comprise a shield layer to shield the signal contacts 92 from electromagnetic interference from electricity traveling through the power contacts 96.

This front end reduced height of the connector 80 also allows the plug receiving areas of the receptacle 10 to be smaller than otherwise possible for a USB+power connection system. However, in alternate embodiments, the receptacle 10 could be configured to receive any suitable type of USB+power plug. The receiving areas 46, 48 of the receptacle 10 are also adapted to receive standard USB plugs (i.e. USB plugs which do not have power electrical contacts) in sections 50 and 51. In addition, the USB+power plug 80 could be used with other types of electrical connector receptacles.

Figure 6:
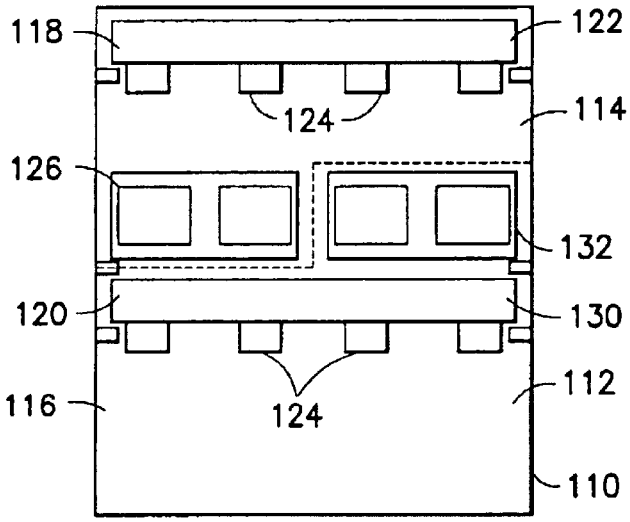
FIG. 6 is a schematic view of an alternate embodiment of the electrical connector receptacle with two plugs connected thereto.
Figure 7:
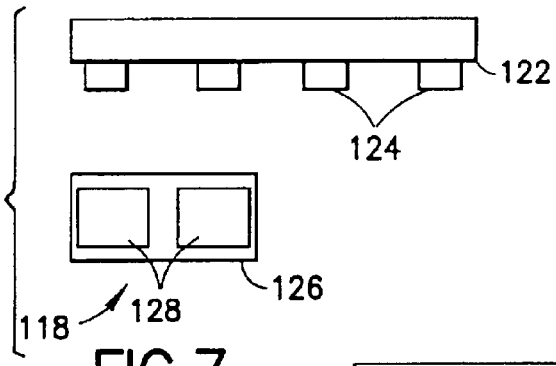
FIG. 7 is a schematic front elevational view of one of the plugs shown in FIG. 6.
Figure 8:
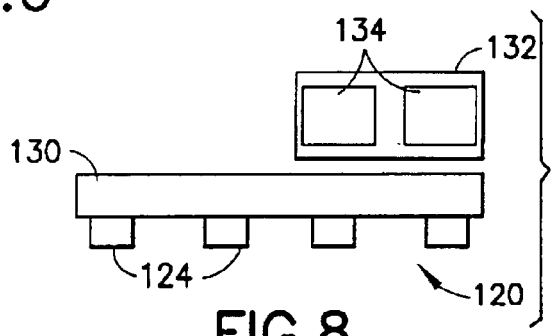
FIG. 8 is a schematic front elevational view of one of the plugs shown in FIG. 6.

Referring now to FIGS. 6–8 there is shown a schematic view of an alternate embodiment of the present invention. In this embodiment, the USB+power electrical connector 110 has a receiving area 112 with a first section 114 and a second section 116. The first section 114 is sized and shaped to receive a first USB+power plug 118. The second section 116 is sized and shaped to receive a second different USB+power plug 120. The first plug 118 comprises a contact supporting deck 122 and USB signal contacts 124 on a bottom side of the deck 122. The first plug 118 also comprises a power section 126 having two power contacts 128. The power section 126 is located opposite the signal contacts 124.

The second plug 120 comprises a contact supporting deck 130, USB signal contacts 124 on a bottom side of the deck 130, and a power section 132. The power section 132 comprises power contacts 134. The power section 132 is located on an opposite side of the deck 130 than the signal contacts 124. As seen in FIG. 6, when the first and second plugs 118, 120 are inserted into the receiving area 112 the signal contacts 124 of the two connectors 118, 120 all face in a same direction. The power sections 126, 132 are both located between the two decks 122, 130. In this embodiment, the two power sections 126, 132 are located laterally adjacent each other. However, in an alternate embodiment, the two power sections 126, 132 could be vertically offset, at least partially, from each other.

Figure 9:
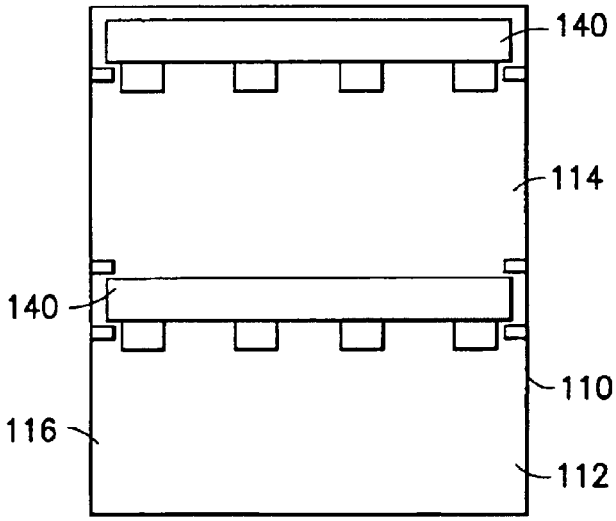
FIG. 9 is a schematic view of the electrical connector receptacle shown in FIG. 6 having two other types of USB plugs connected thereto.

Referring now also to FIG. 9, the receptacle connector 110 is shown having two other different types of USB plugs 140 connected thereto. The plugs 140 do not comprise a power section. The plugs 140 are standard USB plugs. The plugs 140 can be received in either one of the sections 114, 116 of the receiving area 112. Thus, the receptacle connector 110 is adapted to receive three different types of USB plugs; the first USB+power plug 118, the second USB+power plug 120, and/or the standard USB without power plug 140. The receptacle 110 could receive one of the standard USB without power plugs 140 with one of the other USB+power plugs 118 or 120.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

electrical contacts comprising signal contacts and power contacts; and a housing having the electrical contacts connected thereto, the housing comprising at least two vertically arranged electrical plug receiving areas, wherein the signal contacts extend into the receiving areas in a universal serial bus (USB) electrical conductor location configuration, wherein the power contacts extend into the receiving areas on respective sides of the receiving areas that are opposite the signal contacts in each receiving area, and wherein in each receiving area the signal contacts are located along only a first one of the sides and the power contacts are located along only a second one of the sides opposite the first side.

2. An electrical connector as in claim 1 wherein the housing comprises a section between two of the plug receiving areas, and wherein the power contacts extend from the section into the two plug receiving areas.

3. An electrical connector as in claim 1 wherein the electrical contacts extending into a first one of the plug receiving areas are arranged as a substantially mirror image to the electrical contacts extending into a second one of the plug receiving areas.

4. An electrical connector as in claim 1 wherein each plug receiving area comprises four of the signal contacts extending thereinto and two of the power contacts extending thereinto opposite the four signal contacts.

5. An electrical connector as in claim 1 wherein the signal contacts comprise spring contact sections extending into the plug receiving areas, tails extending from a bottom side of the housing, and bent sections therebetween.

6. An electrical connector as in claim 5 wherein the spring contact sections of the signal contacts extend into two of the plug receiving areas in opposite directions.

7. An electrical connector as in claim 1 wherein the power contacts comprise spring contact sections extending into the plug receiving areas, tails extending from a bottom side of the housing, and bent sections therebetween.

8. An electrical connector as in claim 7 wherein the spring contact sections of the power contacts extend into two of the receiving areas in respective opposite directions.

9. An electrical connector as in claim 1 further comprising an electrically conductive shell connected to the housing, the shell comprising contacts extending into the plug receiving areas.

10. An electrical connector as in claim 9 wherein the housing comprises projections extending into the receiving areas in a forward direction, portions of the signal contacts extending through cavities along the projections, and ends of the signal contacts being preloaded against sections of the projections.

11. A universal serial bus (USB) electrical connector comprising:

a housing forming a plurality of USB plug receiving areas;

electrical signal contacts connected to the housing, and extending into the receiving areas, arranged for operably electrically connecting to the USB plugs inserted into the USB plug receiving areas; and electrical power contacts connected to the housing and extending into the receiving areas on respective sides of the receiving areas opposite the signal contacts in each of the receiving areas, wherein the housing has a section between two of the receiving areas, wherein the power contacts extend from the section in opposite directions into the two receiving areas, and wherein the power contacts extend into the two receiving areas only from the housing section and the signal contacts extend into the receiving areas only along sides of the receiving areas opposite the housing section.

12. A universal serial bus electrical connector as in claim 11 wherein the two receiving areas are vertically orientated relative to each other.

13. A universal serial bus electrical connector as in claim 11 wherein the signal and power contacts extending into a first one of the receiving areas are arranged as a substantially mirror image of the signal and power contacts extending into a second one of the receiving areas.

14. A universal serial bus electrical connector as in claim 11 wherein the receiving areas extend into a front side of the housing, and wherein ends of the contacts extend from a bottom side of the housing.

15. A universal serial bus electrical connector as in claim 11 wherein the plug receiving areas are vertically aligned relative to each other, and wherein the electrical signal contacts and the electrical power contacts in the two receiving areas are arranged as substantially mirror images of each other.

16. A universal serial bus electrical connector as in claim 15 further comprising an electrically conductive shell connected to the housing, the shell comprising contact arms which extend into the two receiving areas in opposite directions.

17. An electrical connector comprising:

a housing having two plug receiving areas vertically stacked relative to each other; and electrical contacts connected to the housing and extending into the two plug receiving areas, the contacts comprising signal contacts and power contacts, wherein the power contacts extend into the two receiving areas and the signal contacts extend into the two receiving areas, wherein the signal and power contacts in a first one of the receiving areas are arranged in an array with the signal contacts on a first side of the first receiving area being located opposite the power contacts on an opposite second side in the first receiving area, the array being substantially a mirror image of the signal and power contacts in a second one of the receiving areas, and wherein signal contacts in the first receiving area are located along only the first side and the power contacts in the first receiving area are located along only the second side.

18. An electrical connector as in claim 17 further comprising an electrically conductive shell connected to the housing, the shell comprising contact arms extending into the two receiving areas from four aides of the connector.

19. An electrical connector as in claim 17 wherein the housing comprises a section located between and separating the two plug receiving areas from each other.

20. An electrical connector as in claim 19 wherein the two plug receiving areas are vertically aligned relative to each other.

21. An electrical connector as in claim 19 wherein the power contacts extend from the section in opposite directions into the two receiving areas.

22. An electrical connector as in claim 21 wherein the signal contacts extend into the first and second receiving areas in respective opposite inward directions.

23. An electrical connector as in claim 17 wherein the housing comprises two projections extending towards a front end of the housing above and below a center projection of the housing, and wherein the signal contacts extend through the two projections and project out of the two projections in opposite directions towards the center projection.

24. An electrical connector as in claim 23 wherein the power contacts extend through and out of the center projection in opposite directions into the two plug receiving areas.

25. A universal serial bus (USB) electrical connector receptacle for receiving a plurality of USB electrical connector plugs, the receptacle comprising:

a housing having at least one plug receiving area; and electrical contacts connected to the housing, the contacts comprising signal contacts and power contacts, wherein the at least one plug receiving area is sized and shaped to receive the plurality of USB plugs with signal contact supporting decks of two of the plugs being located vertically aligned relative to each other and power contact supporting sections of the two plugs being at least partially laterally adjacent each other.

26. A universal serial bus electrical connector receptacle as in claim 25 wherein the housing comprises two of the plug receiving areas, the two plug receiving areas being vertically aligned with each other.

27. A universal serial bus electrical connector receptacle as in claim 26 wherein the signal contacts extend into the two receiving areas in a same direction.

28. An electrical connector comprising:

a housing having at least one plug receiving area; and electrical contacts connected to the housing, the contacts comprising signal contacts and power contacts, wherein the at least one plug receiving area comprises:

a first receiving area section sized and shaped to receive a first electrical plug having a signal contact supporting deck and a power contact section vertically offset from the signal contact supporting deck; and a second receiving area section sized and shaped to receive a second electrical plug having a signal contact supporting deck and a power contact section vertically offset from the signal contact supporting deck, and wherein at least one of the first and second receiving area sections is sized and shaped to alternatively receive a third electrical plug having a signal contact supporting deck, but not having a power contact section.

29. An electrical connector as in claim 28 wherein the at least one plug receiving area is sized and shaped to locate the power contact sections of the first and second electrical plugs laterally adjacent to each other.

30. An electrical connector as in claim 29 wherein the first and second receiving area sections are vertically aligned with each other.

31. An electrical connector as in claim 28 wherein the signal contacts and the power contacts extend into the first receiving area section in opposite directions.

32. An electrical connector as in claim 28 wherein the first and second receiving area sections each comprise a deck receiving area for receiving contact supporting decks of the first and second electrical plugs, and a common power contact section receiving area is located between the deck receiving areas.

33. A universal serial bus (USB) electrical connector plug comprising:

a signal contact supporting deck;

electrical signal conductors directly stationarily attached to a first exterior side of the supporting deck; and electrical power conductors directly stationarily attached to an opposite second exterior side of the supporting deck, wherein the supporting deck is sized and shaped to be inserted into a supporting deck receiving aperture of a USB electrical connector receptacle, wherein the electrical signal conductors are aligned in a USB contact array configuration, and wherein the conductors on the supporting deck comprise the first side having only the signal conductors and the second side having only the power conductors.

* * * * *

UNITED STATES PATENT AND TRADEMARK OFFICE

CERTIFICATE OF CORRECTION

PATENT NO. : 6,835,091 B2
DATED : December 28, 2004
INVENTOR(S) : Oleynick et al.

It is certified that error appears in the above-identified patent and that said Letters Patent is hereby corrected as shown below:

Column 10,
Line 28, delete “aides” and replace with -- sides --.

Signed and Sealed this

Fifth Day of April, 2005

JON W. DUDAS
*Director of the United States Patent and Trademark Office*